US010612328B2

(12) United States Patent
Ravi et al.

(10) Patent No.: US 10,612,328 B2
(45) Date of Patent: Apr. 7, 2020

(54) MANAGED PRESSURE SYSTEM FOR PRESSURE TESTING IN WELL BORE OPERATIONS

(71) Applicant: Halliburton Energy Services, Inc., Houston, TX (US)

(72) Inventors: Krishna M. Ravi, Kingwood, TX (US); James Randolph Lovorn, Tomball, TX (US); Krishna Babu Yerubandi, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 43 days.

(21) Appl. No.: 15/774,193

(22) PCT Filed: Jan. 22, 2016

(86) PCT No.: PCT/US2016/014574
§ 371 (c)(1),
(2) Date: May 7, 2018

(87) PCT Pub. No.: WO2017/116485
PCT Pub. Date: Jul. 6, 2017

(65) Prior Publication Data

US 2018/0328128 A1 Nov. 15, 2018

Related U.S. Application Data

(63) Continuation-in-part of application No. PCT/US2015/068230, filed on Dec. 31, 2015.

(51) Int. Cl.
*E21B 21/08* (2006.01)
*E21B 33/14* (2006.01)

(52) U.S. Cl.
CPC ..... *E21B 21/08* (2013.01); *E21B 33/14* (2013.01)

(58) Field of Classification Search
CPC ..... E21B 21/08
(Continued)

(56) References Cited

U.S. PATENT DOCUMENTS 8,899,349 B2 12/2014 Rasmus et al.
2004/0178003 A1 9/2004 Van Riet
(Continued)

FOREIGN PATENT DOCUMENTS

WO 2014/087371 A1 6/2014

OTHER PUBLICATIONS

International Search Report and Written Opinion issued in related PCT Application No. PCT/US2015/068230 dated Sep. 22, 2016, 15 pages.

(Continued)

*Primary Examiner* — Taras P Bemko
(74) *Attorney, Agent, or Firm* — Thomas Rooney; Baker Botts L.L.P.

(57) ABSTRACT

Systems and methods for performing positive and/or negative pressure testing in managed pressure operations in subterranean well bores are provided. In some embodiments, the methods comprise: performing a positive or negative pressure test in a well bore in a subterranean formation, wherein the well bore is maintained in a closed pressure loop, and at least one choke valve is provided in communication with the well bore, the choke valve being coupled to a controller, and during the test in the well bore, monitoring an actual bottomhole pressure in the well bore using data from at least one downhole sensor in the well bore, and if the actual bottomhole pressure in the well bore increases or decreases, manipulating the choke valve using the controller to increase or decrease the bottomhole pressure in the well bore.

20 Claims, 5 Drawing Sheets

(58) Field of Classification Search
USPC ..... 175/25
See application file for complete search history.

(56) References Cited

U.S. PATENT DOCUMENTS

| | | | | |
|---|---|---|---|---|
| 2007/0246263 | A1 | 10/2007 | Reitsma | |
| 2011/0042076 | A1 | 2/2011 | Reitsma | |
| 2012/0285744 | A1 | 11/2012 | Bernard | |
| 2013/0118752 | A1 | 5/2013 | Hannegan et al. | |
| 2013/0186688 | A1* | 7/2013 | Rasmus | E21B 47/06 175/48 |
| 2014/0238668 | A1 | 8/2014 | Bittleston et al. | |
| 2014/0299316 | A1 | 10/2014 | Needham | |
| 2015/0075804 | A1 | 3/2015 | Orbell et al. | |
| 2015/0233198 | A1 | 8/2015 | Leuchtenberg | |

OTHER PUBLICATIONS

International Search Report and Written Opinion issued in related PCT Application No. PCT/US2016/014574 dated Sep. 29, 2016, 17 pages.

International Preliminary Report on Patentability issued in related PCT Application No. PCT/US2016/014574 dated Jul. 12, 2018, 13 pages.

International Preliminary Report on Patentability issued in related PCT Application No. PCT/US2015/068230 dated Jul. 12, 2018, 12 pages.

* cited by examiner

MANAGED PRESSURE SYSTEM FOR PRESSURE TESTING IN WELL BORE OPERATIONS

CROSS-REFERENCE TO RELATED APPLICATIONS

The present application is a U.S. National Stage Application of International Application No. PCT/US2016/014574 filed Jan. 22, 2016 titled "Managed Pressure System for Pressure Testing in Well Bore Operations", which claims priority to and is a continuation-in-part of PCT Application No. PCT/US2015/068230 titled "Control System for Managed Pressure Well Bore Operations" filed Dec. 31, 2015, both of which are incorporated herein by reference in their entirety for all purposes.

BACKGROUND

The present disclosure relates to subterranean operations and, more particularly, to systems and methods for managed pressure operations and testing in subterranean well bores.

In constructing a subterranean well for production of hydrocarbons, once a well bore has been drilled into the subterranean formation of interest, a pipe string (e.g., casing, liners, expandable tubulars, etc.) is often run into the well bore and cemented in place. The process of cementing the pipe string in place is commonly referred to as primary cementing. In a typical primary cementing method, a cement composition may be pumped into an annulus between the walls of the well bore and the exterior surface of the pipe siring disposed therein. The cement composition may set in the annular space, thereby forming an annular sheath of hardened, substantially impermeable cement (e.g., a cement sheath). This cement sheath may support and position the pipe string in the well bore, bond the exterior surface of the pipe string to the subterranean formation, prevent communication and migration of fluids between producing zones, aquifers (and any contamination related thereto), and/or protect the pipe string from corrosion. Remedial cementing methods also may be used, for example, to seal cracks or holes in pipe strings or cement sheaths, to seal highly permeable formation zones or fractures, to place a cement plug, and the like.

It is often desirable or required to verify the integrity of the cement and/or the wellhead seal assembly at the wellbore before hydrocarbon production from that well begins. Positive pressure testing and negative pressure testing (e.g., inflow testing) are two types of testing that are sometimes used to provide this verification. A positive pressure test may be used to check the integrity of the well by testing whether the casing and wellhead seal assembly can contain higher pressure than surrounds them. In a positive pressure test, additional fluid is pumped into the well below any blow-out preventer, the pumps are shut off, and the pressure in the well is monitored. A constant pressure with the pumps shut off typically indicates that the casing, wellhead seal assembly, and blow-out preventer are containing internal pressure and are not leaking. Conversely, in a negative pressure test, the pressure in the well bore is reduced to a level lower than the pressure in the formation (e.g., by pumping heavier fluid out of the well and replacing it with a lighter fluid), and then pressure in the well is monitored with the pumps shut off. A constant pressure in the negative pressure test indicates that the cement in the well can contain fluids in the formation and prevent them from leaking into the well.

Well bores penetrating subterranean zones that contain oil, gas, and/or other fluids typically experience an influx of those fluids into the well bore if the formation fluid pressure is greater than the well bore pressure. Managed pressure techniques are sometimes employed in drilling and cementing of subterranean well bores in order to control the bottom hole pressure in the well bore at the surface (e.g., to maintain pressure above the pore pressure of the formation), and thus control the influx of formation fluids into the well bore during those operations. Unlike conventional techniques that rely on the density of fluids circulated in the well bore to maintain pressure in the well, managed pressure techniques involve the use of backpressure and maintaining the well bore in a closed pressure loop in order to maintain the desired pressure in the well bore. Most systems for managed pressure drilling include a rotating control device, blowout preventer, and a subsystem of chokes, valves, flow lines, pumps, and other equipment installed at the well site to control the pressure in the well bore and flow of fluids into and out of the well bore.

BRIEF DESCRIPTION OF THE FIGURES

These drawings illustrate certain aspects of some of the embodiments of the present disclosure, and should not be used to limit or define the disclosure.

Figure 1:
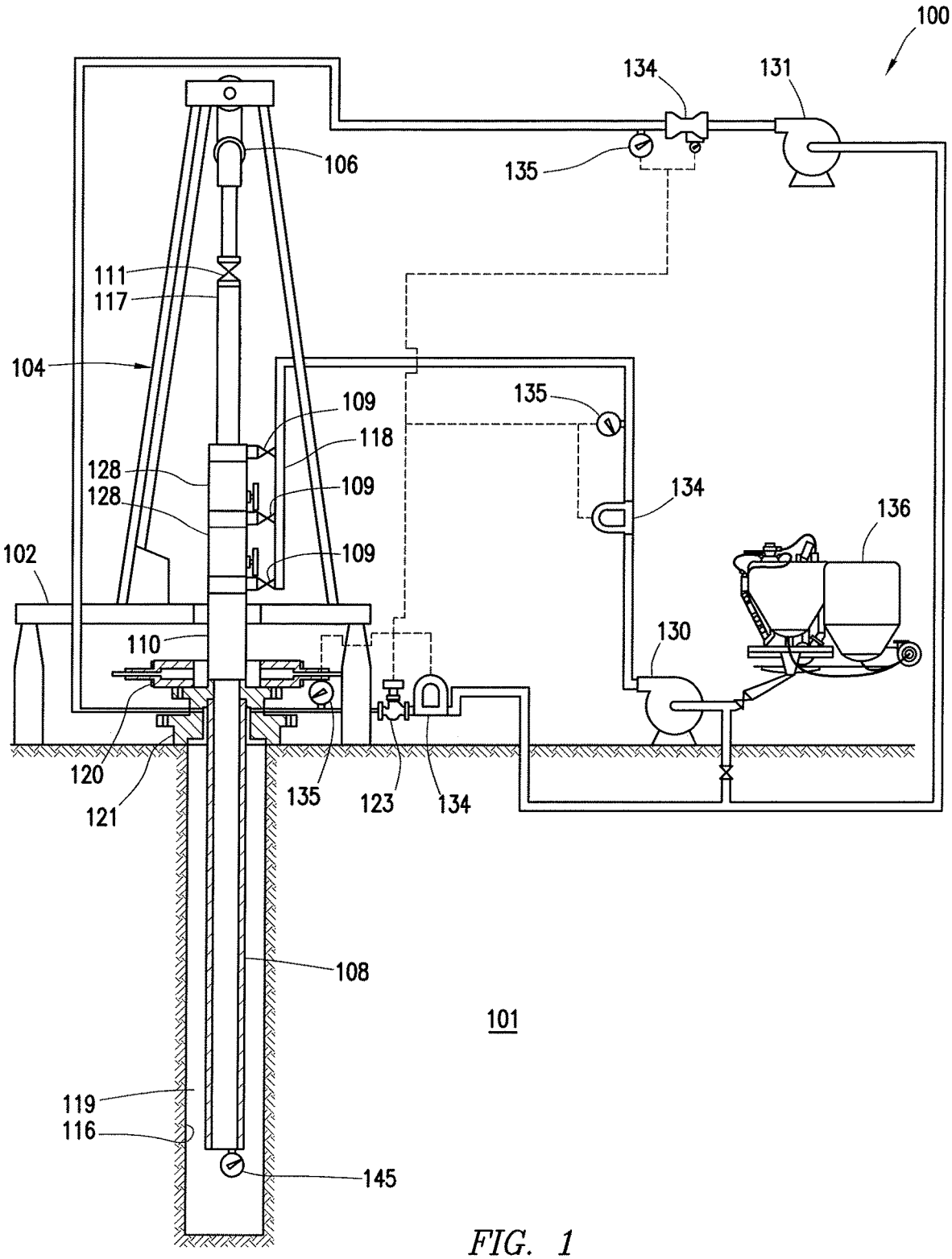
FIG. 1 is a diagram illustrating a well bore system according to certain embodiments of the present disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The present disclosure relates to subterranean operations and, more particularly, to systems and methods for performing positive and/or negative pressure testing in managed pressure operations in subterranean well bores. In particular, the present disclosure provides systems and methods for automating the use of positive and/or negative pressure testing in a well bore using a managed pressure system. In certain embodiments, the well bore comprises at least one tubular casing that has been cemented therein, e.g., wherein a cement has been placed in the annulus between the casing and the well bore wall and the cement has been allowed to at least partially cure or harden. In the methods and systems of the present disclosure, a positive or negative pressure test may be performed in a well bore wherein the wellbore (including the annulus) is "closed" or a part of a "closed pressure loop", in that it does not communicate with the surface but is instead closed by an isolation device, which may include one or more of the rotating control device (RCD), a blow-out preventer (BOP), a packer, or other suitable device. In these methods and systems, a choke valve may selectively control the flow of fluid and/or air into or out of the wellbore.

The systems and methods of the present disclosure use at least one downhole sensor (e.g., a downhole pressure sensor) disposed in the well bore to directly measure bottomhole pressure in the well bore during the positive or negative pressure test. The data from this downhole sensor may be communicated to an information handling system that controls the choke valve and/or other equipment involved in the operation and/or monitoring of the well. If the information handling system receives pressure data in a positive or negative pressure test indicating a leak of fluid into or out of the well bore in excess of acceptable parameters (e.g., an increase or decrease in bottomhole pressure by a predetermined amount), the information handling system may use that information, among other ways, to manipulate the pumps, choke valve, or other equipment at the well site to maintain an acceptable bottomhole pressure in the annulus. In some embodiments, this could avert potentially unsafe situations if problems with negative pressure test are observed.

In certain embodiments, the downhole sensor may measure bottomhole pressure in the well bore periodically and/or substantially continuously during the positive or negative pressure test, and may record that data for subsequent and/or real-time analysis, among other reasons, to identify certain phenomena or potential problems in the well. In certain embodiments, the information handling system may perform all or part of these steps automatically (e.g., without real-time action by an operator). By allowing the information handling system to monitor pressure data during a positive or negative pressure test and automatically control the well bore equipment based on that data, the methods and systems of the present disclosure may facilitate faster and/or more reliable responses when failures or other problems are indicated by those tests.

The systems and methods of the present disclosure may, among other benefits, provide for more effective and accurate monitoring and performance of positive and/or negative pressure testing in a well, particularly in the context of a managed pressure cementing or completions operation. For example, by automating certain aspects of controlling equipment in these operations, the systems and methods of the present disclosure may facilitate quicker and more reliable detection of and/or response to well bore events (e.g., cement failures, influxes of fluids, etc.). The real-time data measurement used in certain embodiments of the present disclosure also may be able to accommodate different types of variables present in managed pressure operations, including but not limited to the different types of fluids, fluid flow (e.g., free-fall), well bore geometries, casing geometries, and other variables not encountered in managed pressure drilling operations. In certain embodiments, the systems of the present disclosure may be able to accommodate higher well bore pressures and/or well bore equipment of nonstandard dimensions, for example, by eliminating certain pressure-limiting or size-limiting equipment such as rotating control devices that are not needed for managed pressure cementing or completions operations. In certain embodiments, the systems and methods of the present disclosure may facilitate more dynamic control of pressure in a well bore during a managed pressure operation, which may allow operators to respond to certain well bore events without ceasing or substantially suspending operations in the well bore.

FIG. 1 illustrates a system 100 according to certain embodiments of the present disclosure for performing and evaluating managed pressure cementing operations involving the cementing of a casing string in a well bore 116 that penetrates a portion of a subterranean formation 101. It should be noted that while FIG. 1 generally depicts a land-based system, those skilled in the art will readily recognize that the principles described herein are equally applicable to subsea operations that employ floating or sea-based platforms and rigs, without departing from the scope of the disclosure. As illustrated, the system 100 may include a platform 102 that supports a derrick 104 having a traveling block 106 for raising and lowering casings, liners, production tubing, drill strings, work strings, and other tubulars or equipment into the well bore 116. Casing string 108 may comprise one or more individual casing joints connected together, as well as other equipment for placing the casing in the well bore (e.g., a shoe, float collar, centralizers, etc.). A casing adapter 110, kelly 111, and spool 117 supports the casing string 108 as it is lowered through an opening in the floor of the platform 102. Although not shown, one or more other casing strings (e.g., surface casing) already may be disposed and/or cemented in well bore 116 uphole of casing string 108.

The system 100 further comprises a blowout preventer (BOP) 120 and a variable choke valve 123, which may be connected to the well bore 116 at wellhead 121. A housing of the BOP 120 may be connected to wellhead 121, such as by a flanged connection. In some embodiments, the BOP housing may also be connected (e.g., by a flanged connection) to a housing of a rotating control device RCD (not shown) into which the casing adapter 110 is inserted. Such RCDs may include a stripper seal for rotation of a casing string or other work string relative to the RCD housing by bearings. Alternatively, in certain embodiments, the RCD may be omitted from system 100 (or removed from a system used to drill well bore 116) and a packer or BOP may be used to form a seal with the casing adapter 110 instead. Omission or removal of the RCD may, among other benefits, allow the system to accommodate pressures higher than the maximum pressure for most RCDs known in the art.

The choke 123 may be connected to an outlet port (not shown) of the wellhead 121, and may be fortified to operate in an environment where return fluid therethrough may include solids. The choke 123 may include one or more isolation valves that are operable by a controller (not shown) (e.g., an electronic controller, a pneumatic controller, a hydraulic controller, etc.) to maintain backpressure in the wellhead 121 at a particular setpoint determined by an information handling system, as described in further detail below.

System 100 may further comprise a cement mixer 136 (such as a recirculating mixer) and a cementing pump 130 connected to a multi-branch cementing manifold 118. Each branch may include a shutoff valve 109 for providing selective fluid communication between the main line of the manifold 118 and one or more plug launchers 128. Each launcher 128 may include a canister for housing a respective cementing plug and retainer valve or latch operable to selectively retain the respective wiper in the launcher. A lower branch of the manifold 118 may connect the manifold trunk directly to the casing adapter 110, thereby bypassing the launchers 128.

System 100 also may further comprise an annulus pump 131, one or more flow meters 134 and one or more pressure sensors 135. For example, the pressure sensor 135 connected between the choke 123 and the wellhead 121 (or at the choke 123) may be operable to monitor wellhead pressure. The pressure sensor 135 connected between an annulus pump 131 and the wellhead 121 and may be operable to monitor a discharge pressure of the annulus pump. The pressure sensor 135 connected between a cement pump 130 and the cementing manifold 118 and may be operable to monitor manifold pressure. The flow meters 134 may each be a mass flow meter, such as a Coriolis flow meter. The cement flow meter 135 connected between the cement pump 130 and the cementing manifold 118 and may be operable to monitor a flow rate of the cement pump. The flow meter 134 connected between the choke 123 and the annulus pump 131 and may be operable to monitor a flow rate of return fluid. The flow meter 34 connected between the annulus pump 130 and the wellhead 121 may be a volumetric flow meter, such as a Venturi flow meter and may be operable to monitor a flow rate of the annulus pump.

System 100 also comprises at least one downhole sensor such as downhole pressure sensor 145, which may comprise any known pressure sensor in the art (including but not limited to piezoresistive sensors, piezoelectric sensors, capacitive sensors, fiber optic sensors, and the like), and may be installed on the casing string 108 or run into the well bore 116 on a wireline or other work string. In certain embodiments, the downhole sensor may comprise a combination of such devices. Pressure sensor 145 thus may be able to directly monitor the bottomhole pressure in well bore 116. Alternatively, in some embodiments, downhole pressure sensor 145 could be replaced with other types of downhole sensors that are used to measure other downhole conditions (e.g., temperature, fluid density, fluid flow rate, heat capacity, fluid viscosity, etc.) that are used to calculate the bottomhole pressure in well bore 116. Additional downhole sensors such as pH sensors, temperature sensors, density sensors, heat capacity sensors, conductivity recorders, chemical sensors, radio frequency (RF) sensors, electromagnetic (EM) sensors, acoustic sensors, and the like may be installed in well bore 116 to directly monitor various conditions and phenomena in the well bore 116. In certain embodiments, there could be a plurality of pressure transducers and/or other downhole sensors or measuring devices (not shown) distributed along the length of the well to measure these parameters at different locations.

Each of flow meters 134, pressure sensors 135, and downhole pressure sensor 145 (as well as other downhole sensors not specifically shown in FIG. 1) may be in data communication with an information handling system (not shown). Choke 123 and the valves in manifold 118 (as well as other valves in the system not specifically shown in FIG. 1) may be communicatively coupled to a controller, which may be in data communication with information handling system. These components may transmit data regarding pressure, fluid flow rates, and/or other conditions in various places in the system 100 and/or well bore 116 to the information handling system, which may use that data to model conditions and/or determine setpoints for the choke valve and/or bottomhole pressure for an ongoing managed pressure cementing operation, as described in further detail below.

To stabilize the casing string 108 in the well bore 116, a cement fluid or slurry may be mixed in the cement mixer 136 and pumped by pump 130 to the cementing manifold 118, downwardly through the bottom of casing string 108, and then upwardly into an annulus 119 formed between the casing 108 and the walls of the well bore 116. In certain embodiments, a cementing fluid of the present disclosure may comprise a base fluid and one or more cementitious materials (e.g., Portland cements, fly ash, pozzolanic cements, gypsum cements, high alumina content cements, silica cements, etc.), and one or more other additives used to impart desired properties to the cement (e.g., set retarders, strengthening additives, and the like). Wiper plugs may be released into the well bore 116 prior to and/or after pumping the cement fluid into the well bore 116, among other reasons, to displace drilling fluid, cement fluid, spacer fluids, or other treatment fluids downhole. Once placed in the annulus, the cement composition is permitted to set therein, thereby forming an annular sheath of hardened, substantially impermeable cement that substantially supports and positions the casing in the well bore and bonds the exterior surface of the casing to the interior wall of the well bore. Once the cement sets, it holds the casing in place, facilitating performance of subterranean operations.

In certain embodiments of the present disclosure, an information handling system is used to automatically control the choke valves at the well site based at least in part on the bottomhole pressure measured in the annulus. The information handling system is communicatively coupled to an electronic controller that controls the operation of the choke valve(s) at the well. The information handling systems of the present disclosure may be configured to receive and process data from sensors in a well bore system (e.g., a downhole pressure sensor) and other data sources to perform a number of functions. For example, the information handling system may use such data to monitor whether a bottomhole pressure or other conditions in a well bore are at (or within acceptable variances of) a setpoint, select or calculate a setpoint for the choke valve and/or bottomhole pressure in the well bore for a managed pressure operation based on that data, incorporate that data into a computational model for a downhole operation, and/or other related functions. The information handling systems of the present disclosure may be further configured to send electrical signals to one or more electronic controllers coupled to various pieces of equipment in a well bore operation system (e.g., choke valves, BOPs, RCDs, pumps, etc.) to automate their operation.

Figure 2:
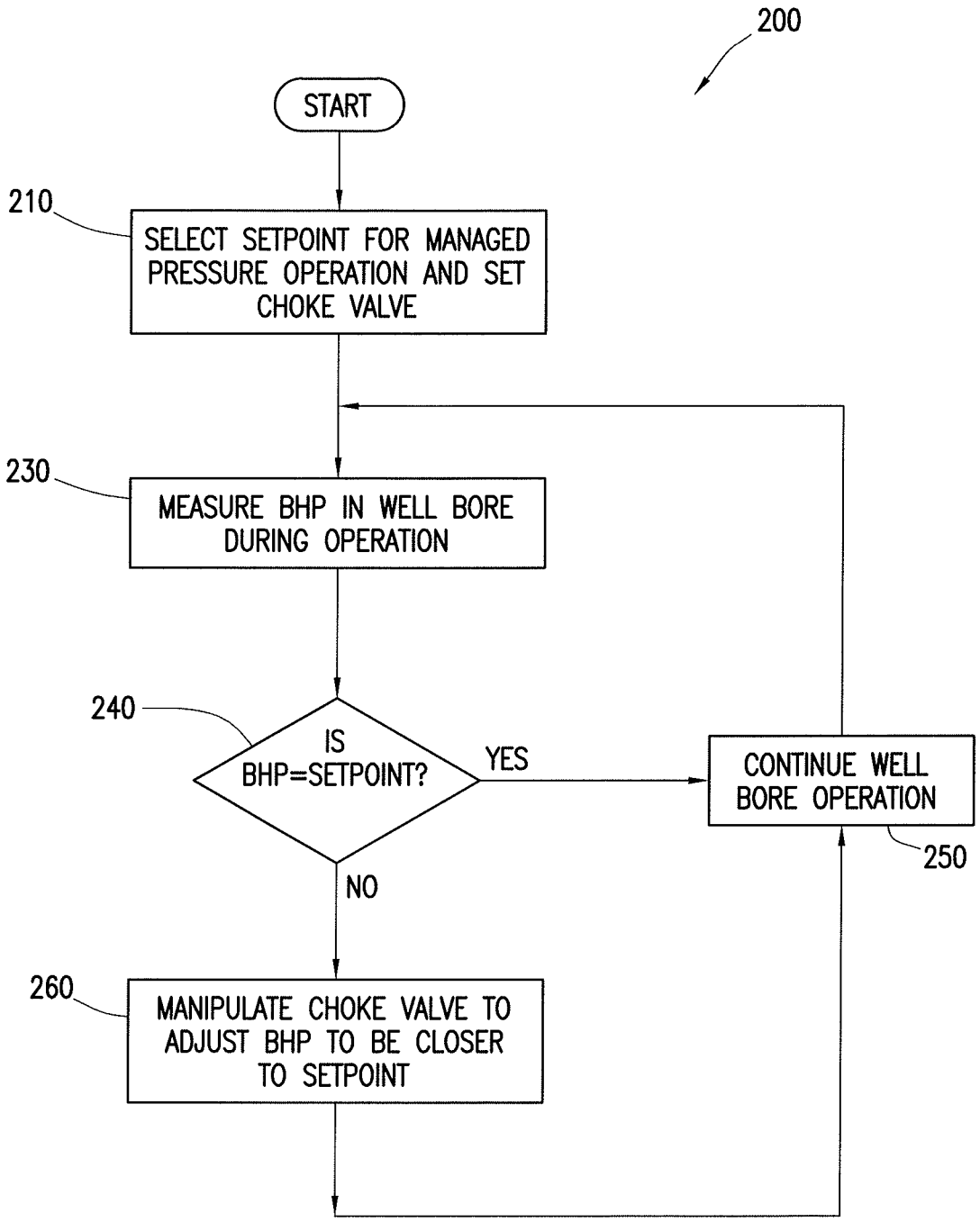
FIG. 2 is a flowchart illustrating certain aspects of methods for performing managed pressure well bore operations according to certain embodiments of the present disclosure.

Certain embodiments of the methods of the present disclosure are illustrated in the flowchart provided in FIG. 2. The process 200 shown in FIG. 2 may be used in the performance of any managed pressure cementing or completions operation, and may be performed in whole or in part by an information handling system as described above. At the start of the operation, a setpoint for the choke valve for the managed pressure operation is selected at step 210 and the choke valve may be set to maintain that setpoint, and the cementing or completion fluids for the operation may be pumped into the well bore. In certain embodiments, this setpoint may be determined by the operator, an information handling system, or any other suitable source, and may be determined prior to or during the performance of the managed pressure operation itself. In certain embodiments, the setpoint may be determined by referencing a lookup table in the literature or a database listing proposed setpoints for certain types of operations, formations, or other parameters. In other embodiments, the setpoint may be determined with reference to a computational model created or modified by the information handling system, as described in further detail below. At step 230, a downhole pressure sensor measures the actual bottomhole pressure in the well bore (e.g., in the annulus of a well bore where a casing string resides) and communicates that data to the information handling system. At step 240, the information handling system determines whether the actual bottomhole pressure measured in the well bore is equal to the setpoint for the bottomhole pressure. If so, the well bore operation may be continued at step 250 at the current settings until the next BHP measurement is made. If the actual BHP in the well bore is not equal to the setpoint, at step 260 the information handling system may send one or more signals to an electronic controller that controls the operation of the choke valve (and optionally other equipment being used in the well bore operation) to increase or decrease the BHP as needed to approach the desired setpoint. Once the adjustment is made, the well bore operation may continue at step 250 until the next BHP measurement is made.

With the input of bottomhole pressure as measured or otherwise determined by the downhole sensors, the information handling system can also create and/or modify a computational fluid dynamics or equivalent model in real-time for the hydrodynamic state of the well during a particular well bore operation, which may be used to set parameters for the automatic operation of the choke (and optionally other equipment) during the managed pressure well bore operation. For example, in certain embodiments, the information handling system may create a computerized model for predicting various properties or conditions in a cementing or completion operation (including but not limited to compressive strength, rheological properties, height, and/or bonding of the cement, equivalent circulating density of a fluid, etc.) at the existing setpoint and/or bottomhole pressure as well as any number of other possible setpoints and/or bottomhole pressures for the well. Based on those models and the desired properties of the cement or completion, a system of the present disclosure may automatically manipulate the chokes and/or other equipment to cause the bottomhole pressure to match the previously-selected setpoint or a new setpoint for bottomhole pressure in the well bore based at least in part on the computational model. In certain embodiments, the desired setpoint for bottomhole pressure during the operation may be calculated or recalculated by the information handling system (using the computational model as well as other data measured in the system) to account for certain events occurring in the well bore such as kicks, production of fluids, changes in composition of formation fluids, fluid leakage, or other changes to conditions in the well bore. In certain embodiments, the information handling system also may be configured to shut down all or part of the operation in response to pressure conditions or other conditions indicating certain types of dangerous or unanticipated well bore events.

The computerized model for the hydrodynamic state of a well bore in a closed pressure loop during a subterranean operation of the present disclosure may be generated with real-time data regarding flow rate, fluid density, fluid rheology, back pressure, wellbore geometry, or any combination thereof, and then correlated with real-time measurement of surface pressure and bottomhole pressure. The hydrodynamic state of the well bore at any given time may be defined by the fluid concentrations, flow rates/velocities, and pressure in the wellbore (as a function of length, or 3 spatial dimensions). In other words, the hydrodynamic state of the well bore at time n+1 is a function of the following:

1. Hydrodynamic state of the well bore at time n;
2. Pumping Rate/Flow Rate of the fluid in the well bore;
3. Density of the incoming fluid into the well bore;
4. Rheology of the incoming fluid into the well bore;
5. Wellbore geometry; and
6. Back Pressure applied to the well bore.

Computer models may be generated to estimate back pressure (which may be used as a setpoint to control the choke valve) required at time n+1 to keep the bottomhole pressure in the well bore within the pore pressure and fracture gradient tolerance of the subterranean formation. This is done by iterative generating future models for range of back pressures to arrive at a set point for the back pressure controlled at the choke valve. In some embodiments, models correlated to real-time sensor measured downhole pressure can indicate losses, driving to the models to use additional safety margins to the pore pressure and fracture gradient window for the formation.

Such models may be generated by using a series of equations to calculate various values for the hydrodynamic state of the well bore based on realtime data measured in the well bore. An example of a set of equations for velocity and pressure (continuity and momentum) of fluid flow in the formation may be provided by Equations (1)-(4) below.

$$\frac{\partial \rho}{\partial t} = \frac{\partial(\rho v_x)}{\partial x} + \frac{\partial(\rho v_y)}{\partial y} + \frac{\partial(\rho v_z)}{\partial z} \tag{1}$$

$$\frac{\partial(\rho v_x)}{\partial t} + \frac{\partial(\rho v_x v_x)}{\partial x} + \frac{\partial(\rho v_y v_x)}{\partial y} + \frac{\partial(\rho v_z v_x)}{\partial z} = -\left[\frac{\partial \tau_{xx}}{\partial x} + \frac{\partial \tau_{yx}}{\partial y} + \frac{\partial \tau_{zx}}{\partial z}\right] - \frac{\partial P}{\partial x} + \rho g_x \tag{2}$$

$$\frac{\partial(\rho v_y)}{\partial t} + \frac{\partial(\rho v_x v_y)}{\partial x} + \frac{\partial(\rho v_y v_y)}{\partial y} + \frac{\partial(\rho v_z v_y)}{\partial z} = -\left[\frac{\partial \tau_{xy}}{\partial x} + \frac{\partial \tau_{yy}}{\partial y} + \frac{\partial \tau_{zy}}{\partial z}\right] - \frac{\partial P}{\partial y} + \rho g_y \tag{3}$$

$$\frac{\partial(\rho v_y)}{\partial t} + \frac{\partial(\rho v_x v_y)}{\partial x} + \frac{\partial(\rho v_y v_y)}{\partial y} + \frac{\partial(\rho v_z v_y)}{\partial z} = -\left[\frac{\partial \tau_{xz}}{\partial x} + \frac{\partial \tau_{yz}}{\partial y} + \frac{\partial \tau_{zz}}{\partial z}\right] - \frac{\partial P}{\partial z} + \rho g_z \tag{4}$$

In Equations (1)-(4) above, $\rho$ is the density of the fluid, $v_x$, $v_y$, $v_z$ are the velocities in x, y, z directions respectively, P is the pressure, and $g_x$ is the gravitational constant, $\tau_{ij}$ is the stress tensor in ij direction where i,j can take all the three directions x, y, z. Stress tensor is related to fluid velocities and the relationship is defined the rheology of the fluid. Fluid concentration may be given by Equation (5) below.

$$\frac{\partial(c_i)}{\partial t} + \frac{\partial(c_i v_x)}{\partial x} + \frac{\partial(c_i v_y)}{\partial y} + \frac{\partial(c_i z)}{\partial z} = D\left[\frac{\partial^2 c_i}{\partial x^2} + \frac{\partial^2 c_i}{\partial y^2} + \frac{\partial^2 c_i}{\partial y^2}\right] + s \tag{5}$$

In Equation (5), $c_i$ is the concentration of the fluid, D is the diffusivity of the fluid, and S is the source term to account for fluid losses in the wellbore due to lost circulation. The above equations in 3 dimensions (or simplified equations in lesser dimensions) may be solved numerically to estimate the hydrodynamic state of the well bore at any given time using Pumping Rate, Back Pressure, Density of the incoming fluid as boundary conditions and Rheology as input the momentum equations. An appropriate setpoint for the desired bottomhole pressure (and corresponding setpoint for the choke valve) may be selected based on the hydrodynamic state of the well bore and the estimated pore pressure/fracture gradient of the formation.

For example, a simplified momentum balance equation (e.g., based on Equations (2), (3), and (4) above) for 1-dimensional system would give rise to Equation (6) below.

$$-\frac{dP}{dz}+\rho g_x=\frac{dP}{dz_{friction}}+\frac{dP}{dz_{surge/swab}} \tag{6}$$

Integrating this expression yields Equation (7) below, which can be used to calculate bottomhole pressure (BHP) based applied back pressure and the wellbore conditions.

$$BHP=(\text{Back Pressure})+(\text{Hydrostatic Pressure})+(\text{Surge/Swab Pressure})+(\text{Friction Pressure}) \tag{7}$$

The required choke valve set point for the back pressure calculated above can be calculated by iteratively executing Equation (7) and identifying the Back Pressure that gives a BHP within pore pressure and fracture gradient. A person of skill in the art with the benefit of this disclosure will recognize other methods that may be used to calculate the setpoint using data available in a particular method or system of the present disclosure.

At step 221, the information handling system may use the magnitude of the difference between the actual BHP measured in the well bore to the expected BHP to determine if the well bore event is significant or dangerous enough to require shutdown of the system based on predetermined definitions or parameters. If the information handling system determines that the event requires shutdown, at step 223, the information handling system may send signals to one or more electronic controllers in the system controlling the operation of various pieces of equipment in the system to shut in the well and/or suspend further operations until the conditions triggering the shutdown are resolved or an operator manually resumes operations. By allowing the information handling system to monitor pressure data and automatically shut down the well bore equipment based on that data, the methods and systems of the present disclosure may facilitate faster and/or more reliable responses when failures or other problems are indicated by those tests.

If the information handling system determines that the event does not satisfy predetermined definitions or parameters that require shutdown, at step 225, the information handling system may use the actual BHP measured in the well to re-calculate or select a new setpoint for the managed pressure operation that takes into account the variance from the model due to the detected event, and set the choke valve to continue with the managed pressure operation at that setpoint (e.g., in the process shown in FIG. 2). This process may be repeated at one or more points during the course of a particular managed pressure operation at any desired points or frequency.

Figure 3:
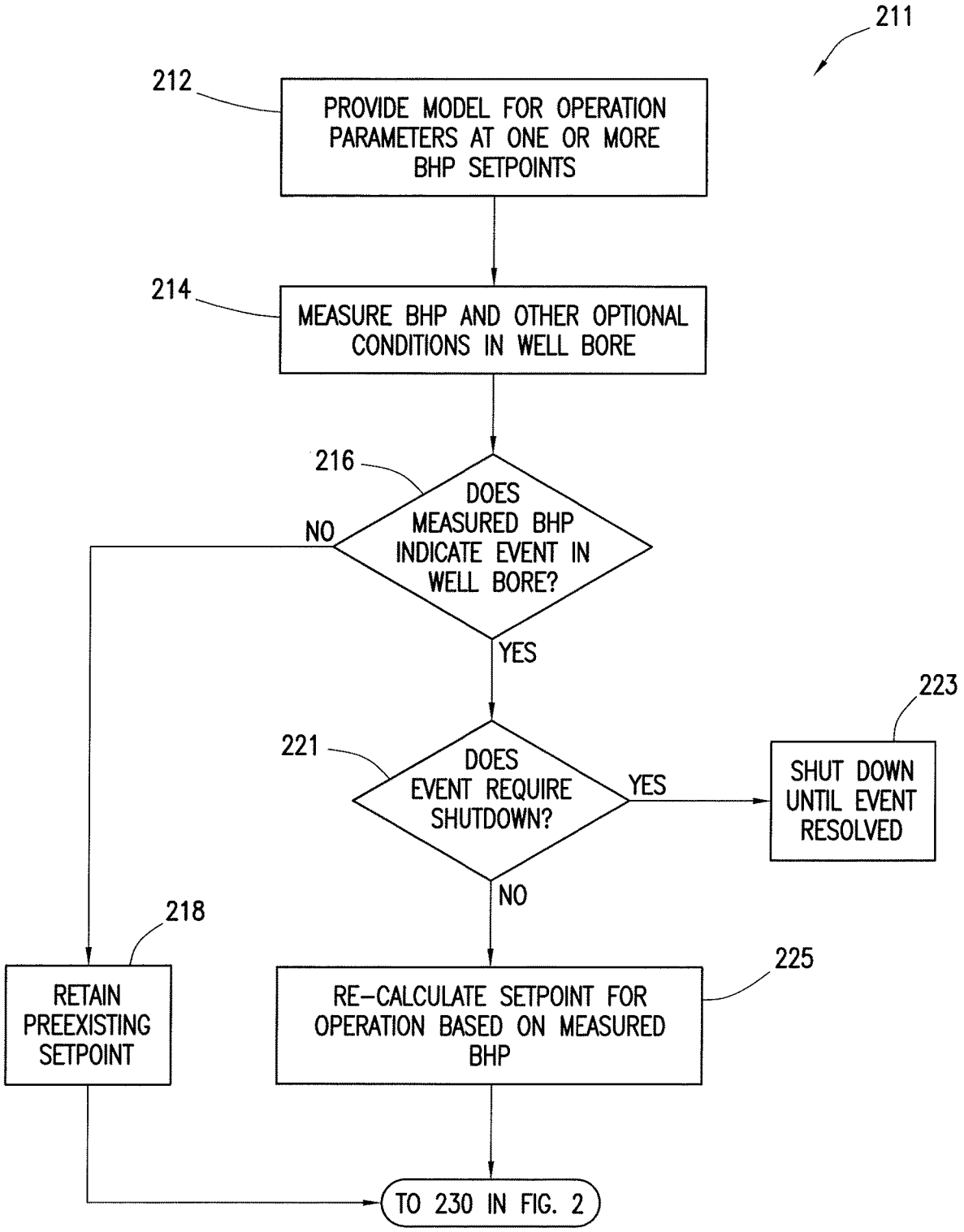
FIG. 3 is a flowchart illustrating certain aspects of methods for performing managed pressure well bore operations according to certain embodiments of the present disclosure.

In certain embodiments of the present disclosure, a system for managed pressure cementing, such as the system shown in FIG. 1, may be used in conjunction with positive and/or negative pressure testing performed in the well. For example, at some point after a managed pressure cementing operation as described above (e.g., as shown in FIGS. 2 and 3), one or more positive and/or negative pressure tests may be performed to verify the integrity of the casing and/or the cement once the cement has been allowed to at least partially cure or harden. Certain embodiments of the methods of the present disclosure involving such tests are illustrated in the flowcharts provided in FIGS. 4 and 5.

Figure 4:
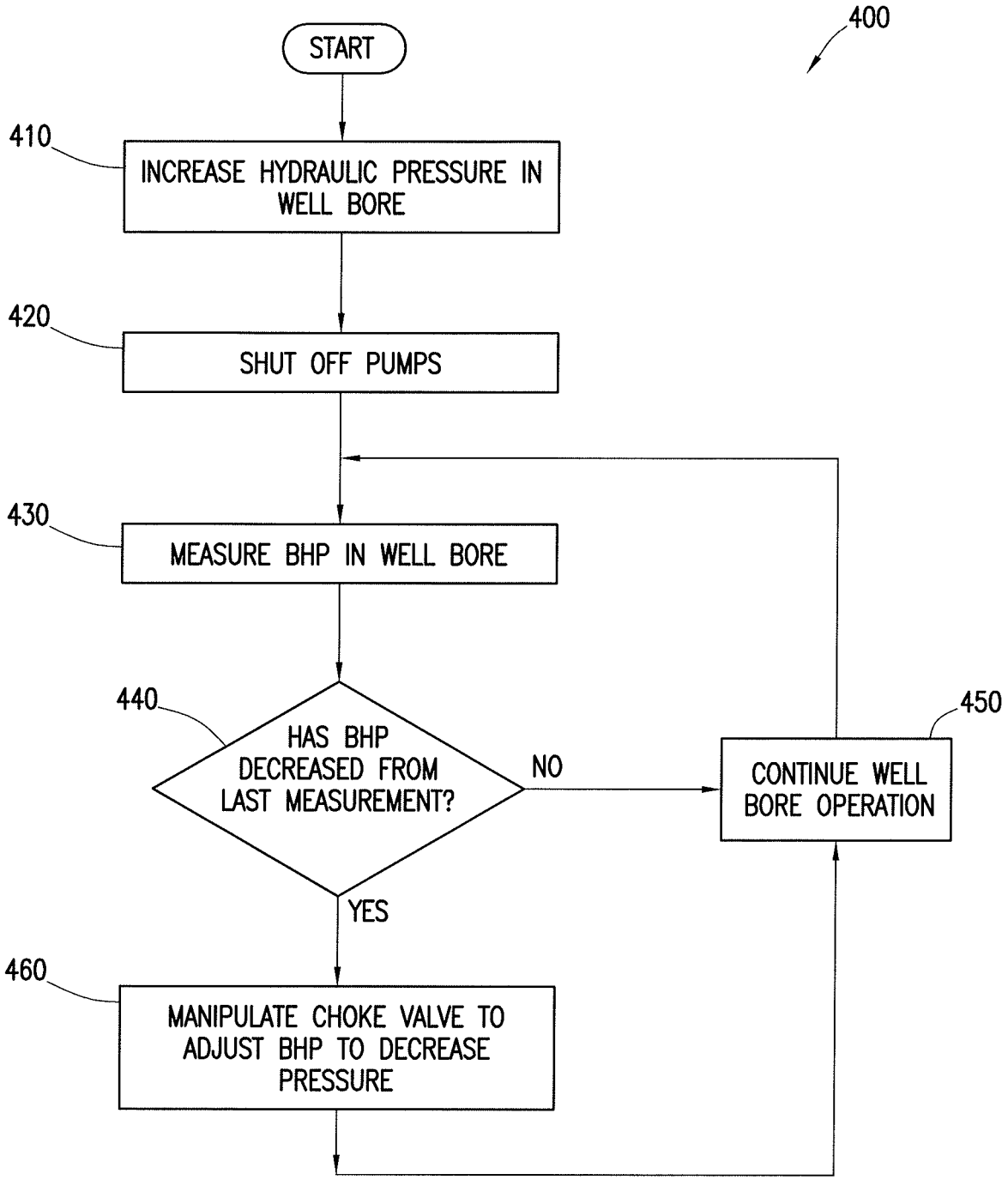
FIG. 4 is a flowchart illustrating certain aspects of methods for performing positive pressure tests according to certain embodiments of the present disclosure.

Referring to FIG. 4, an example of a process 400 involving a positive pressure test is shown. At step 410, the hydraulic pressure in the well bore is increased above the hydraulic pressure of the formation, for example, by pumping additional fluid and/or heavier fluid (e.g., water, spacer fluid, etc.) into the well below any BOP, RCD, packer, or other well sealing device to be tested. At step 420, the pumps into the well bore are shut off, and the bottomhole pressure in the well bore is measured via the downhole sensor disposed in the well at step 430. At step 440, the information handling system determines whether the bottomhole pressure in the well bore has decreased by a predetermined (e.g., tolerance) amount as compared to the previous measurement. If the bottomhole pressure has not decreased, at step 450, the well bore operation and/or testing may be continued and, as shown, the bottomhole pressure in the well may be measured again after a certain period of time. If the bottomhole pressure has decreased, at step 460, the information handling system may send one or more signals to an electronic controller that controls the operation of the choke valve (and optionally other equipment being used in the well bore operation) to decrease the bottomhole pressure while still maintaining the bottomhole pressure above the pore pressure in the formation. This pressure adjustment may, among other benefits, stop or slow any leakage of fluid out of the well bore while still maintaining the stability of the well bore. In certain embodiments, after step 460, the well bore operation may be continued in step 450 without any significant shut-down or suspension of the managed pressure operation.

Figure 5:
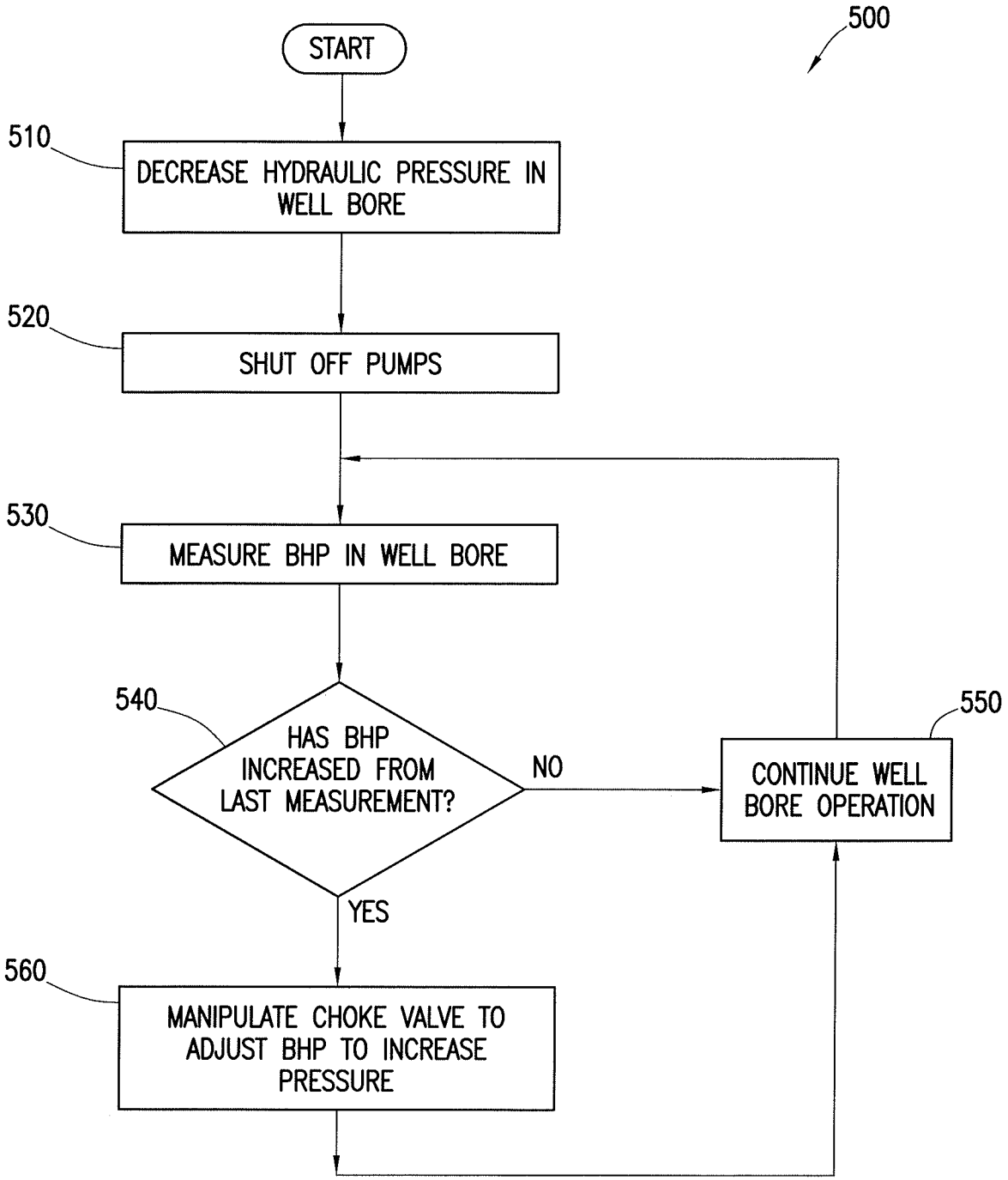
FIG. 5 is a flowchart illustrating certain aspects of methods for performing negative pressure tests according to certain embodiments of the present disclosure.

Referring to FIG. 5, an example of a process 500 involving a negative pressure test is shown. At step 510, hydraulic pressure in the well bore is decreased below the hydraulic pressure in the formation, for example, by pumping the existing fluid out of the well bore and replacing it with a lighter fluid (e.g., water, spacer fluid, etc.). At step 520, the pumps into the well bore are shut off, and the bottomhole pressure in the well bore is measured via the downhole sensor disposed in the well at step 530. At step 540, the information handling system determines whether the bottomhole pressure in the well bore has increased by a predetermined (e.g., tolerance) amount as compared to the previous measurement. If the bottomhole pressure has not increased, at step 550, the well bore operation and/or testing may be continued and, as shown, the bottomhole pressure in the well may be measured again after a certain period of time. If the bottomhole pressure has increased, at step 560, the information handling system may send one or more signals to an electronic controller that controls the operation of the choke valve (and optionally other equipment being used in the well bore operation) to increase the bottomhole pressure, among other reasons, to stop or slow any influx of fluid into the well bore, but not to an extent that would induce substantial fluid loss into the formation. In certain embodiments, after step 560, the well bore operation may be continued in step 550 without any significant shut-down or suspension of the managed pressure operation.

As a person of ordinary skill in the art will recognize with the benefit of this disclosure, in certain embodiments, one or more positive pressure tests and/or negative pressure tests of the present disclosure may be performed in series in the same well bore using the same system or equipment. For example, a positive pressure test of the present disclosure may be performed in a well bore, followed by performing a negative pressure test of the present disclosure in the same well bore (or vice-versa). In certain embodiments, the positive and/or negative pressure test(s) of the present disclosure may be repeated periodically in the same well, for example, by programming the information handling system to perform those tests automatically at certain predetermined points in time or after certain predetermined time intervals.

In certain embodiments, a downhole chemical sensor optionally may be provided or installed in the well bore or casing (e.g., in the flowpath from the shoe in a casing) and may provide data regarding the composition of any fluid leaking into the well bore during a negative pressure test, which may indicate the nature and/or source of the fluid leaking into the well bore. For example, if the fluid is of a composition that is known to exist in a particular zone of the formation, the possible location(s) of the leak along the length of the well bore may be more readily identified or narrowed.

Although FIGS. 1-5 and other portions of this disclosure have generally described systems used in the course of managed pressure cementing operations, similar equipment and methods may be applied to other managed pressure completion operations in subterranean well bores where the well bore is maintained in a "closed" configuration such that bottomhole pressure can be controlled at the surface. Such completion operations may involve the placement of packers, production tubing, and/or any other equipment in the well to prepare the well for production, and the positive and/or negative pressure tests of the present disclosure may be performed in the course of those operations as well.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer or tablet device, a cellular telephone, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more devices for reading storage media, one or more network ports for communication with external devices as well as various input and output (I/O) devices, such as a keyboard, a mouse, and a video display. The information handling system may also include one or more buses operable to transmit communications between the various hardware components. As would be appreciated by those of ordinary skill in the art, with the benefit of this disclosure, the information handling system may be communicatively coupled to the components through wired or wireless connections to facilitate data transmission to or from other components of the system. The information handling system used in the embodiments of the present disclosure may be located at the well site or, alternatively, may be provided at a remote location. When the information handling system is remotely located, it may communicate with the electronic controller for the choke system and/or the downhole pressure sensor (as well as any other optional sensors in the system) via an external communications interface installed at the well site. The external communications interface may be connected to and permit an information handling system at a remote location communicatively coupled to the external communications interface via, for example, a satellite, a modem or wireless connections to send signals to and/or receive signals from one or more components at the well site. In certain embodiments, the external communications interface may include a router.

Any suitable processing application software package may be used by the information handling to process the data from the downhole pressure sensor and other optional sensors in the system. In one embodiment, the software produces data that may be presented to the operation personnel in a variety of visual display presentations such as a display. In certain example system, the measured value set of parameters, the expected value set of parameters, or both may be displayed to the operator using the display. For example, the measured-value set of parameters may be juxtaposed to the expected-value set of parameters using the display, allowing the user to manually identify, characterize, or locate a downhole condition. The sets may be presented to the user in a graphical format (e.g., a chart) or in a textual format (e.g., a table of values). In another example system, the display may show warnings or other information to the operator when the central monitoring system detects a downhole condition. Suitable information handling systems and software packages may include those used in the iCem® service or the GeoBalance® Managed Pressure Drilling service provided by Halliburton Energy Services, Inc. In certain embodiments, the software package may be provided to an information handling system via programming into the hardware of that system, via computer-readable media, or a combination thereof.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein are intended to mean either an indirect or a direct connection. Thus, if a first device couples to a second device, that connection may be through a direct connection, or through an indirect electrical connection via other devices and connections. The term "communicatively coupled" as used herein is intended to mean coupling of components in a way to permit communication of information therebetween. Two components may be communicatively coupled through a wired or wireless communication network, including but not limited to Ethernet, LAN, fiber optics, radio, microwaves, satellite, and the like. Operation and use of such communication networks is well known to those of ordinary skill in the art and will, therefore, not be discussed in detail herein.

It will be understood that the term "oil well cementing equipment" or "oil well cementing system" is not intended to limit the use of the equipment and processes described with those terms to cementing in an oil well. The terms also encompass cementing or other operations natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

An embodiment of the present disclosure is a method comprising: performing a positive pressure test in a well bore penetrating at least a portion of a subterranean formation, wherein the well bore is maintained in a closed pressure loop, and at least one choke valve is provided in communication with the well bore, the choke valve being coupled to a controller; and during the positive pressure test in the well bore, monitoring an actual bottomhole pressure in the well bore using data from at least one downhole sensor disposed in the well bore, and if the actual bottomhole pressure in the well bore decreases by a predetermined amount, manipulating the choke valve using the controller to decrease the bottomhole pressure in the well bore.

Another embodiment of the present disclosure is a method comprising: performing a negative pressure test in a well bore penetrating at least a portion of a subterranean formation, wherein the well bore is maintained in a closed pressure loop, and at least one choke valve is provided in communication with the well bore, the choke valve being coupled to a controller; and during the negative pressure test in the well bore, monitoring an actual bottomhole pressure in the well bore using data from at least one downhole sensor disposed in the well bore, and if the actual bottomhole pressure in the well bore increases by a predetermined amount, manipulating the choke valve using the controller to increase the bottomhole pressure in the well bore.

Another embodiment of the present disclosure is a system for performing positive or negative pressure testing in a well bore penetrating at least a portion of a subterranean formation, the system comprising: an isolation device disposed at the well bore that closes the well bore in a closed pressure loop; at least one choke valve in communication with the well bore; a controller coupled to and configured to manipulate the choke valve; one or more pumps in communication with the well bore; a downhole sensor disposed in the well bore; and an information handling system communicatively coupled to the controller and the downhole sensor, the information handling system being configured to: receive data relating to an actual bottomhole pressure in the well bore from the downhole sensor during a positive or negative pressure test, determine if the actual bottomhole pressure in the well bore has changed by a predetermined amount during the positive or negative pressure test, and if the actual bottomhole pressure in the well bore has changed by a predetermined amount during the positive or negative pressure test, send one or more signals to the controller to manipulate the choke valve to decrease or increase the bottomhole pressure in the well bore.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. The terms in the claims have their plain, ordinary meaning unless otherwise explicitly and clearly defined by the patentee.

What is claimed is:

1. A method comprising:

performing a cementing operation to cement a tubular casing string in a well bore penetrating at least a portion of a subterranean formation;

performing a positive pressure test in the well bore, wherein the well bore is maintained in a closed pressure loop during the cementing operation and the positive pressure test, and at least one choke valve is provided in communication with the well bore, the choke valve being coupled to a controller; and during the positive pressure test in the well bore:

monitoring an actual bottomhole pressure in the well bore using data from at least one downhole sensor disposed in the well bore, and if the actual bottomhole pressure in the well bore decreases by a predetermined amount, manipulating the choke valve using the controller to decrease the bottomhole pressure in the well bore.

2. The method of claim 1 wherein:

the data from the downhole sensor is communicated to an information handling system;

the information handling system determines if the actual bottomhole pressure in the well bore decreases by a predetermined amount; and manipulating the choke valve comprises causing the information handling system to send one or more signals to the controller for manipulating the choke valve.

3. The method of claim 1 wherein:

the positive pressure test is performed during the course of one or more operations in the well bore; and if the actual bottomhole pressure in the well bore decreases by a predetermined amount, the one or more operations are not substantially suspended.

4. The method of claim 1 wherein the closed pressure loop is maintained by an isolation device disposed at the well bore, the isolation device selected from the group consisting of: a rotating control device, a blow-out preventer, a packer, and any combination thereof.

5. The method of claim 1 wherein the closed pressure loop is maintained by an isolation device disposed at the well bore, wherein the isolation device does not comprise a rotating control device.

6. The method of claim 1 wherein the controller comprises an electronic controller.

7. The method of claim 1, wherein performing the positive pressure test comprises:

pumping additional fluid into the well bore via at least one pump; and subsequently shutting off the at least one pump and monitoring an actual bottomhole pressure in the well bore.

8. The method of claim 1, further comprising:

during the cementing operation:

monitoring an actual bottomhole pressure in the well bore, and if the actual bottomhole pressure in the well bore is not equal to a setpoint, manipulating the choke valve using the controller to adjust the bottomhole pressure toward the setpoint.

9. The method of claim 1, further comprising:

during the positive pressure test in the well bore:

if the actual bottomhole pressure in the well bore decreases by the predetermined amount, manipulating the choke valve using the controller to decrease the bottomhole pressure in the well bore while maintaining the bottomhole pressure above a pore pressure of the subterranean formation.

10. A method comprising:

performing a cementing operation to cement a tubular casing string in a well bore penetrating at least a portion of a subterranean formation;

performing a negative pressure test in the well bore, wherein the well bore is maintained in a closed pressure loop during the cementing operation and the negative pressure test, and at least one choke valve is provided in communication with the well bore, the choke valve being coupled to a controller; and during the negative pressure test in the well bore:

monitoring an actual bottomhole pressure in the well bore using data from at least one downhole sensor disposed in the well bore, and if the actual bottomhole pressure in the well bore increases by a predetermined amount, manipulating the choke valve using the controller to increase the bottomhole pressure in the well bore.

11. The method of claim 10 wherein:

the data from the downhole sensor is communicated to an information handling system;

the information handling system determines if the actual bottomhole pressure in the well bore increases by a predetermined amount; and manipulating the choke valve comprises causing the information handling system to send one or more signals to the controller for manipulating the choke valve.

12. The method of claim 10 wherein:

the negative pressure test is performed during the course of one or more operations in the well bore; and if the actual bottomhole pressure in the well bore increases by a predetermined amount, the one or more operations are not substantially suspended.

13. The method of claim 10 wherein the closed pressure loop is maintained by an isolation device disposed at the well bore, the isolation device selected from the group consisting of: a rotating control device, a blow-out preventer, a packer, and any combination thereof.

14. The method of claim 10 wherein the closed pressure loop is maintained by an isolation device disposed at the well bore, wherein the isolation device does not comprise a rotating control device.

15. The method of claim 10, wherein performing the negative pressure test comprises:

reducing a pressure in the well bore to a level lower than a pressure in the formation via at least one pump; and subsequently shutting off the at least one pump and monitoring an actual bottomhole pressure in the well bore.

16. The method of claim 10, further comprising:

during the negative pressure test in the well bore:

if the actual bottomhole pressure in the well bore increases by the predetermined amount, manipulating the choke valve using the controller to increase the bottomhole pressure in the well bore while preventing substantial fluid loss from the well bore to the subterranean formation.

17. A system for performing positive or negative pressure testing in a well bore penetrating at least a portion of a subterranean formation, the system comprising:

an isolation device disposed at the well bore that closes the well bore in a closed pressure loop;

at least one choke valve in communication with the well bore;

a controller coupled to and configured to manipulate the choke valve;

one or more pumps in communication with the well bore, wherein at least one of the one or more pumps is a cementing pump;

a downhole sensor disposed in the well bore; and an information handling system communicatively coupled to the controller and the downhole sensor, the information handling system being configured to:

receive data relating to an actual bottomhole pressure in the well bore from the downhole sensor during a cementing operation performed via the cementing pump, determine if the actual bottomhole pressure in the well bore during the cementing operation is not equal to a setpoint, if the actual bottomhole pressure in the well bore is not equal to a setpoint during the cementing operation, send one or more signals to the controller to manipulate the choke valve to adjust the bottomhole pressure of the well bore, receive data relating to an actual bottomhole pressure in the well bore from the downhole sensor during a positive or negative pressure test, determine if the actual bottomhole pressure in the well bore has changed by a predetermined amount during the positive or negative pressure test, and if the actual bottomhole pressure in the well bore has changed by a predetermined amount during the positive or negative pressure test, send one or more signals to the controller to manipulate the choke valve to decrease or increase the bottomhole pressure in the well bore.

18. The system of claim 17 wherein the downhole sensor comprises a downhole pressure sensor.

19. The system of claim 17 wherein the controller comprises an electronic controller.

20. The system of claim 17 wherein the isolation device does not comprise a rotating control device.

* * * * *